US011438708B1

(12) United States Patent
Kuo et al.

(10) Patent No.: US 11,438,708 B1
(45) Date of Patent: Sep. 6, 2022

(54) METHOD FOR PROVIDING OCCLUDED SOUND EFFECT AND ELECTRONIC DEVICE

(71) Applicant: HTC Corporation, Taoyuan (TW)

(72) Inventors: Yan-Min Kuo, Taoyuan (TW); Li-Yen Lin, Taoyuan (TW)

(73) Assignee: HTC Corporation, Taoyuan (TW)

( * ) Notice: Subject to any disclaimer, the term of this patent is extended or adjusted under 35 U.S.C. 154(b) by 60 days.

(21) Appl. No.: 17/185,878

(22) Filed: Feb. 25, 2021

(51) Int. Cl.
*H04R 25/00* (2006.01)
*G10K 11/00* (2006.01)

(52) U.S. Cl.
CPC ..... *H04R 25/453* (2013.01); *G10K 11/002* (2013.01); *H04R 2460/05* (2013.01)

(58) Field of Classification Search
CPC .. H04S 2400/11; H04S 2420/01; H04S 7/303; H04S 7/305; G06F 3/011; G06F 3/04815; G06F 3/165; H04R 5/033; H04R 25/453; H04R 2460/05; G10K 11/002
USPC ..... 381/61, 63, 17, 310, 303, 56
See application file for complete search history.

(56) References Cited

U.S. PATENT DOCUMENTS

2008/0240448 A1* 10/2008 Gustafsson ..... H04S 7/30 381/17
2012/0206452 A1* 8/2012 Geisner ..... G06V 10/26 345/419

* cited by examiner

*Primary Examiner* — Norman Yu
(74) *Attorney, Agent, or Firm* — JCIPRNET

(57) ABSTRACT

The embodiments of the disclosure provide a method for providing an occluded sound effect and an electronic device. The method includes: providing a virtual environment, wherein the virtual environment comprises a first object, and the first object is approximated as a second object; defining an object detection range of a sound source based on a sound ray originated from the sound source; in response to determining that the first object enters the object detection range, defining a reference plane based on a reference point on the second object and the sound ray, wherein the reference plane has an intersection area with the object detection range; projecting the second object onto the reference plane as a first projection; determining a sound occluding factor based on the intersection area and the first projection; and adjusting a sound signal based on the sound occluding factor.

20 Claims, 5 Drawing Sheets

METHOD FOR PROVIDING OCCLUDED SOUND EFFECT AND ELECTRONIC DEVICE

BACKGROUND

1. Field of the Invention

The present disclosure generally relates to a mechanism for adjusting sound effect, in particular, to a method for providing an occluded sound effect and an electronic device.

2. Description of Related Art

In the process of transmitting sounds in spaces, the sounds will be affected by the transmission distance in the transmission path, the size of the space, the environmental material and the occlusion of sound blockers, etc., such that the acoustic characteristics such as volume, timbre, and frequency response curve may be changed.

When scene/game designers use the development engine to design scenes/games, if they need to add object occlusion detection and object occlusion ratio calculations, they will use the built-in functions such as "Collider", "collision event detection" and "Raycast" to achieve occlusion detection and occlusion ratio calculation.

For a to-be-calculated object, the "Collider" that matches the shape of the object would be used based on the range of collision detection. In the space for detecting sound blockers, one or more rays may be set in the space for detect occlusions, wherein each ray may be emitted from the sound source to the sound receiver (e.g., a listener). In addition, conditions like ray range and maximum distance may be determined for each ray.

Next, whether a ray collides with the collider on the object may be detected based on the "collision event detection", such that whether a sound blocker exists in the transmission path may be detected, and the occluding factor can be calculated based on the number of the rays corresponding to the detected collision events.

Since almost all behaviors related to physic status changes are involved with colliders, the calculations for the colliders will consume a certain part of processing resources. Moreover, due to the advancement of hardware specifications, the requirements for the details of scenes/games are getting higher and higher, such that the importance of computing performance and resource allocation is also relatively increased. Therefore, if the computational complexity of the central processing unit and graphics card may be reduced, it will be beneficial to the scene/game development.

SUMMARY OF THE INVENTION

Accordingly, the disclosure is directed to a method for providing an occluded sound effect and an electronic device, which may be used to solve the above technical problems.

The embodiments of the disclosure provide a method for providing an occluded sound effect, adapted to an electronic device. The method includes: providing a virtual environment, wherein the virtual environment comprises a first object, and the first object is approximated as a second object; defining an object detection range of a sound source based on a sound ray originated from the sound source, wherein the object detection range extends from the sound source to a sound receiver; in response to determining that the first object enters the object detection range, defining a reference plane based on a reference point on the second object and the sound ray, wherein the reference plane has an intersection area with the object detection range; projecting the second object onto the reference plane as a first projection; determining a sound occluding factor based on the intersection area and the first projection; and adjusting a sound signal based on the sound occluding factor, wherein the sound signal is provided by the sound source to the sound receiver.

The embodiments of the disclosure provide an electronic device including a storage circuit and a processor. The storage circuit stores a program code. The processor is coupled to the storage circuit and accesses the program code to perform: providing a virtual environment, wherein the virtual environment comprises a first object, and the first object is approximated as a second object; defining an object detection range of a sound source based on a sound ray originated from the sound source, wherein the object detection range extends from the sound source to a sound receiver; in response to determining that the first object enters the object detection range, defining a reference plane based on a reference point on the second object and the sound ray, wherein the reference plane has an intersection area with the object detection range; projecting the second object onto the reference plane as a first projection; determining a sound occluding factor based on the intersection area and the first projection; and adjusting a sound signal based on the sound occluding factor, wherein the sound signal is provided by the sound source to the sound receiver.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the disclosure.

DESCRIPTION OF THE EMBODIMENTS

Figure 1:
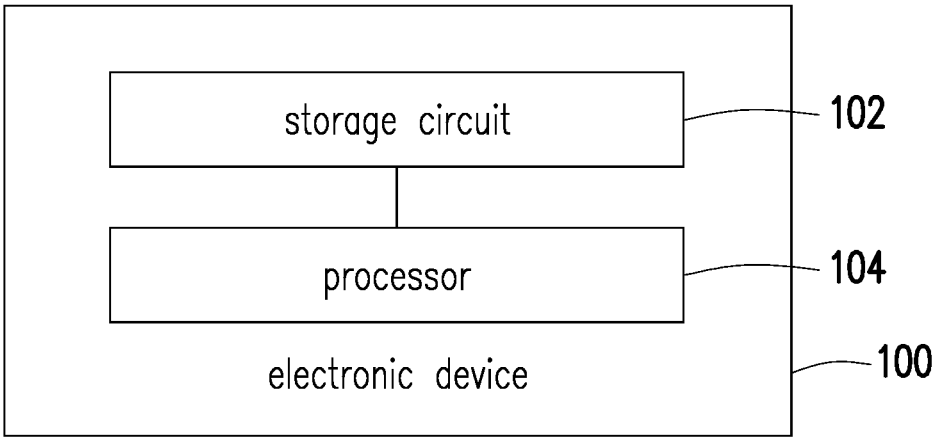
FIG. 1 shows a schematic diagram of an electronic device according to an exemplary embodiment of the disclosure.

Reference will now be made in detail to the present preferred embodiments of the invention, examples of which are illustrated in the accompanying drawings. Wherever possible, the same reference numbers are used in the drawings and the description to refer to the same or like parts.

See FIG. 1, which shows a schematic diagram of an electronic device according to an exemplary embodiment of the disclosure. In various embodiments, the electronic device 100 may be any devices that could provide visual contents (e.g., VR contents) to the user. In the embodiments of the disclosure, the electronic device 100 may be a host of a VR system, wherein the VR system may include other elements such as a head-mounted display (HMD), a VR controller, a position tracking element, but the disclosure is not limited thereto. In other embodiments, the electronic device 100 may also be a standalone VR HMD, which may generate and display VR contents to the user thereof, but the disclosure is not limited thereto.

In FIG. 1, the electronic device 100 includes a storage circuit 102 and a processor 104. The storage circuit 102 is one or a combination of a stationary or mobile random access memory (RAM), read-only memory (ROM), flash memory, hard disk, or any other similar device, and which records a plurality of modules that can be executed by the processor 104.

The processor 104 may be coupled with the storage circuit 102, and the processor 104 may be, for example, a graphic processing unit (GPU), a general purpose processor, a special purpose processor, a conventional processor, a digital signal processor (DSP), a plurality of microprocessors, one or more microprocessors in association with a DSP core, a controller, a microcontroller, Application Specific Integrated Circuits (ASICs), Field Programmable Gate Array (FPGAs) circuits, any other type of integrated circuit (IC), a state machine, and the like.

In the embodiments of the disclosure, the processor 104 may access the modules and/or the program codes stored in the storage circuit 102 to implement method for providing an occluded sound effect provided in the disclosure, which would be further discussed in the following.

Figure 2:
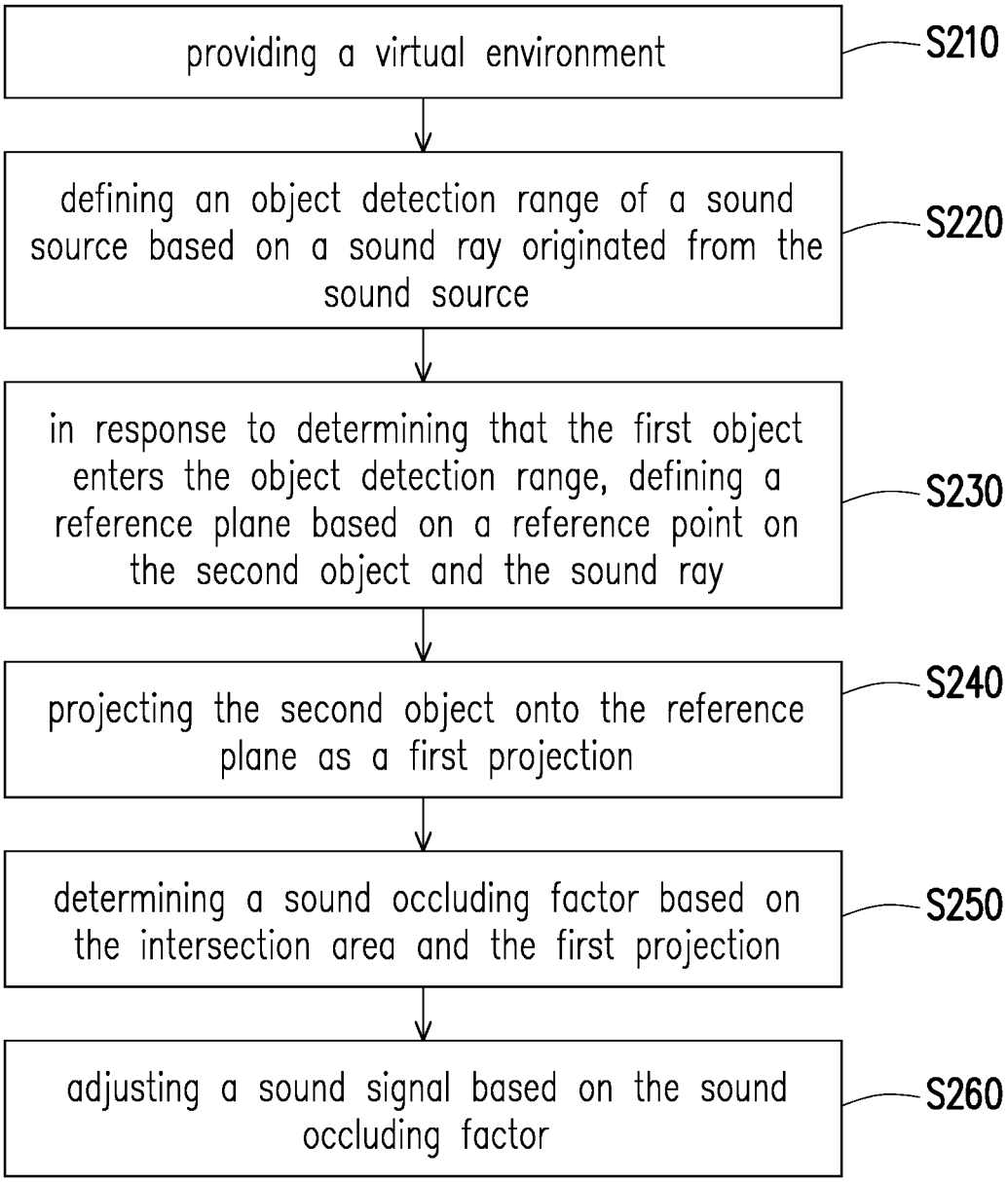
FIG. 2 shows a flow chart of the method for providing an occluded sound effect according to an embodiment of the disclosure.

See FIG. 2, which shows a flow chart of the method for providing an occluded sound effect according to an embodiment of the disclosure. The method of this embodiment may be executed by the electronic device 100 in FIG. 1, and the details of each step in FIG. 2 will be described below with the components shown in FIG. 1.

In step S210, the processor 104 may provide a virtual environment, wherein the virtual environment may include a first object. In various embodiments, the virtual environment may be the VR environment provided by the VR system, and the first object may be one of the VR objects in the VR environment, but the disclosure is not limited thereto.

In the embodiments of the disclosure, each VR objects in the virtual environment may be approximated, by the developer, as a corresponding 3D object having simple texture, such as a sphere, a polyhedron, or the like. For example, a keyboard object may be approximated/represented as a cuboid with the corresponding size but without the texture of a keyboard, and a basketball object may be approximated/represented as a sphere with the corresponding size but without the texture of a basketball, but the disclosure is not limited thereto. Accordingly, the first object may be approximated as a second object as well, wherein the second object may be a sphere or a polyhedron with a size close to the size of the first object, but the disclosure is not limited thereto.

Roughly speaking, by approximating/charactering the first object as the second object, the subsequent procedure of the calculations of the sound occluding factor of the first object may be simplified, and the details would be discussed in the following.

In step S220, the processor 104 may define an object detection range of a sound source based on a sound ray originated from the sound source. For better understanding the concept of the disclosure, FIG. 3 would be used as an example.

Figure 3:
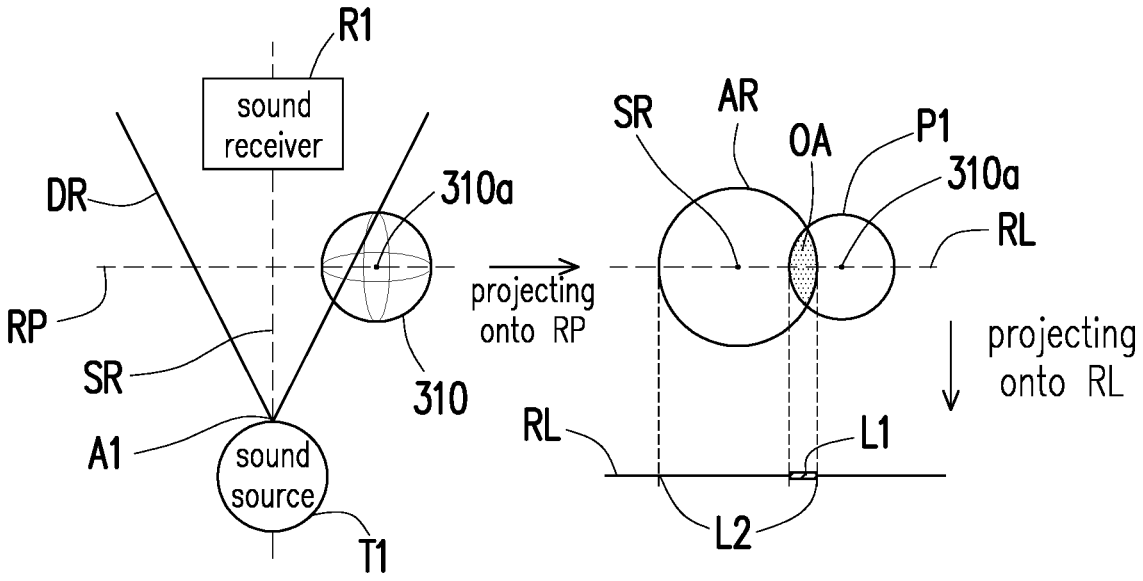
FIG. 3 shows a top view of an application scenario according to a first embodiment of the disclosure.

See FIG. 3, which shows a top view of an application scenario according to a first embodiment of the disclosure. In FIG. 3, the first object is approximated as the second object 310, which may be a sphere with simple texture. In the embodiment, the sound source T1 may be any VR object that is capable of providing sounds, and the sound receiver R1 may be any VR object that could receive the sounds from the sound source T1.

In FIG. 3, the processor 104 may define a sound ray SR originated from the sound source T1, wherein the sound ray SR may be similar to the ray used in "Raycast", but the disclosure is not limited thereto. Next, the processor 104 may define an object detection range DR of the sound source T1 based on the sound ray SR.

In the embodiments of the disclosure, the object detection range DR may be a cone space having an apex A1 on the sound source T1 and centered at the sound ray SR. In other embodiments, the object detection range DR may be designed as other kinds of 3D space that extends from the sound source T1 along the sound ray SR, but the disclosure is not limited thereto. In FIG. 3, since the sound ray SR is assumed to point to the sound receiver R1, the object detection range DR may be understood as extending from the sound source T1 to the sound receiver R1.

In the embodiments of the disclosure, the processor 104 may determine whether an object enters the object detection range DR. If yes, it represents that this object is possible to occlude the sound transmission between the sound source T1 and the sound receiver R1. For simplicity, the first object would be assumed to be the object entering the object detection range DR, and the second object 310 would correspondingly enter the object detection range DR along with the first object, but the disclosure is not limited thereto.

Accordingly, in step S230, in response to determining that the first object enters the object detection range DR, the processor 104 may define a reference plane RP based on a reference point 310*a* on the second object 310 and the sound ray SR. In FIG. 3, the reference point 310*a* may be a center of the second object 310, and the reference plane RP may include the reference point 310*a* on the second object 310 and is perpendicular to the sound ray SR. In other embodiments, the reference plane RP may be designed to be any plane passing the object detection range DR and the second object 310, but the disclosure is not limited thereto.

In FIG. 3, the reference plane RP may have an intersection area AR with the object detection range DR. In detail, since the reference plane RP is assumed to be perpendicular to the sound ray SR and the object detection range DR is assumed to be a cone space centered at the round ray SR, the area where the object detection range DR intersects with the reference plane RP may be a circular area as the intersection area AR shown in FIG. 3, but the disclosure is not limited thereto.

In step S240, the processor 104 may project the second object 310 onto the reference plane RP as a first projection P1. In the embodiment, since the second object 310 is assumed to be a sphere, the first projection P1 of the second object 310 on the reference plane RP may be a circle as shown in FIG. 3, but the disclosure is not limited thereto.

In step S250, the processor 104 may determine a sound occluding factor based on the intersection area AR and the first projection P1. In detail, as could be observed in FIG. 3, the first projection P1 may have an overlapped area OA with the intersection area AR. Accordingly, in one embodiment, the processor 104 may determine the sound occluding factor as a ratio of the overlapped area OA over the intersection area AR. More specifically, assuming that the size of the overlapped area OA is x and the size of the intersection area AR is y, the sound occluding factor may be determined to be x/y, but the disclosure is not limited thereto.

In another embodiment, in the process of determining the sound occluding factor, the processor 104 may define a reference line RL based on the intersection area AR and the first projection P1, wherein the reference line RL may pass the intersection area AR and the first projection P1. In FIG. 3, the reference line RL may intersect with the sound ray SR, include the reference point 310*a* on the second object 310, and is perpendicular with the sound ray SR, but the disclosure is not limited thereto.

Next, the processor 104 may project the overlapped area OA onto the reference line RL as a first line segment L1 and project the intersecting area AR onto the reference line RL as a second line segment L2, but the disclosure is not limited thereto. In addition, the processor 104 may determine the sound occluding factor as a first ratio of the first line segment L1 over the second line segment L2. More specifically, assuming that the length of the first line segment L1 is m and the length of the second line segment L2 is n, the sound occluding factor may be determined to be m/n, but the disclosure is not limited thereto.

After obtaining the sound occluding factor, in step S260, the processor 104 may adjust a sound signal based on the sound occluding factor, wherein the sound signal is provided by the sound source T1 to the sound receiver R1. In the embodiments of the disclosure, how the processor 104 adjusts the sound signal based on the sound occluding factor may be referred to the relevant prior arts, which would not be further provided.

Accordingly, the embodiments of the disclosure may obtain the sound occluding factor in a way with lower computation complexity, such that the computation resource of the VR system may be utilized more efficiently.

Figure 4:
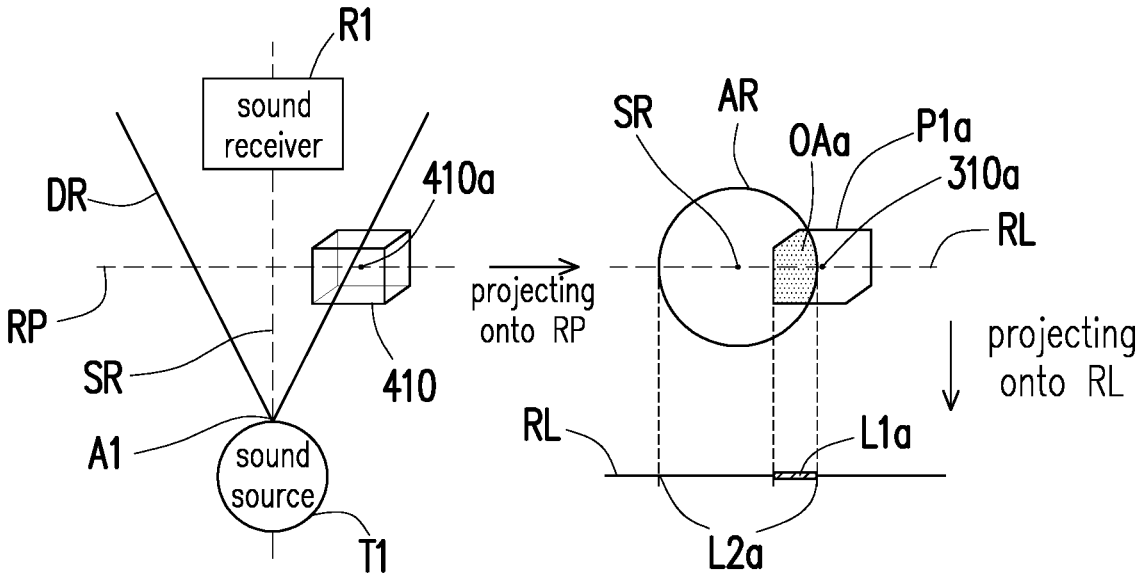
FIG. 4 shows a top view of an application scenario according to a second embodiment of the disclosure.

See FIG. 4, which shows a top view of an application scenario according to a second embodiment of the disclosure. In FIG. 4, other than the second object 410 for characterizing the first object entering the object detection range DR is assumed to be a cuboid, the scenario of FIG. 4 is similar to FIG. 3, and the details of the processor 104 for performing steps S210-S230 may be referred to the first embodiment, which would not be repeated herein.

Since the second object 410 is assumed to be a cuboid, the first projection P1*a* of the second object 410 on the reference plane RP may be a polygon with 6 edges as shown in FIG. 4, but the disclosure is not limited thereto.

Next, the processor 104 may determine a sound occluding factor based on the intersection area AR and the first projection P1*a*. In detail, as could be observed in FIG. 4, the first projection P1*a* may have an overlapped area OAa with the intersection area AR. Accordingly, in one embodiment, the processor 104 may determine the sound occluding factor as a first ratio of the overlapped area OAa over the intersection area AR. More specifically, assuming that the size of the overlapped area OAa is x and the size of the intersection area AR is y, the sound occluding factor may be determined to be x/y, but the disclosure is not limited thereto.

In another embodiment, in the process of determining the sound occluding factor, the processor 104 may define a reference line RL based on the intersection area AR and the first projection P1*a*, wherein the reference line RL may pass the intersection area AR and the first projection P1*a*. In FIG. 4, the reference line RL may intersect with the sound ray SR, include the reference point 410*a* on the second object 410, and is perpendicular with the sound ray SR, but the disclosure is not limited thereto.

Next, the processor 104 may project the overlapped area OAa onto the reference line RL as a first line segment L1*a* and project the intersecting area AR onto the reference line RL as a second line segment L2*a*, but the disclosure is not limited thereto. In addition, the processor 104 may determine the sound occluding factor as a first ratio of the first line segment L1*a* over the second line segment L2*a*. More specifically, assuming that the length of the first line segment L1*a* is m and the length of the second line segment L2*a* is n, the sound occluding factor may be determined to be m/n, but the disclosure is not limited thereto.

After obtaining the sound occluding factor, in step S260, the processor 104 may adjust a sound signal based on the sound occluding factor, wherein the sound signal is provided by the sound source T1 to the sound receiver R1. In the embodiments of the disclosure, how the processor 104 adjusts the sound signal based on the sound occluding factor may be referred to the relevant prior arts, which would not be further provided.

Accordingly, the embodiments of the disclosure may obtain the sound occluding factor in a way with lower computation complexity, such that the computation resource of the VR system may be utilized more efficiently.

In other embodiments, since the information of the height of the first projection P1*a* may be lost while projecting the first projection P1*a* onto the reference line RL, the disclosure further provides a mechanism for solving this issue.

Figure 5:
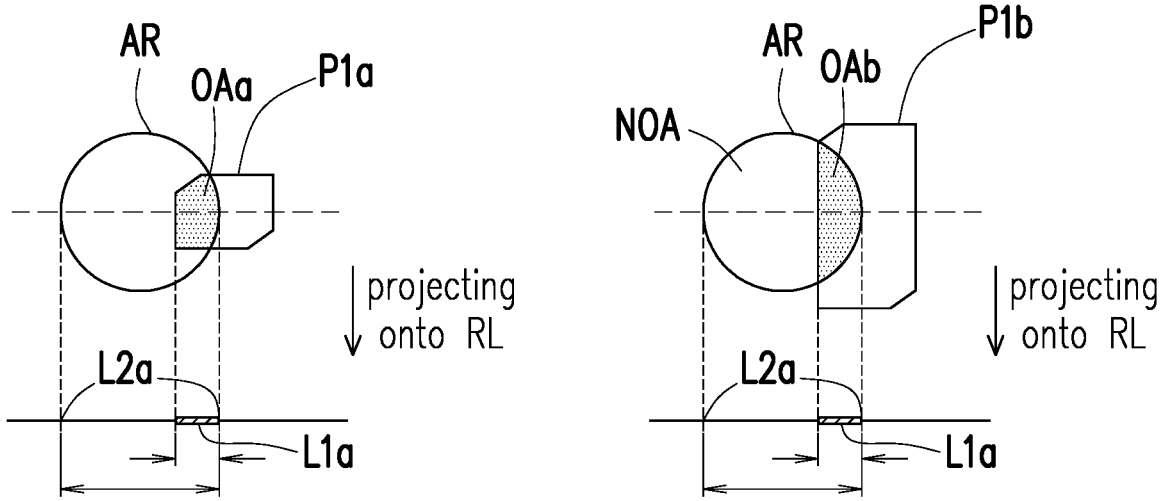
FIG. 5 shows a correcting mechanism according to FIG. 4.

See FIG. 5, which shows a correcting mechanism according to FIG. 4. In FIG. 5, the left part corresponds to the scenario of FIG. 4, and the details thereof would not be repeated herein. In the right part of FIG. 5, the scenario (referred to as a third embodiment) is almost identical to FIG. 4 other than the considered second object is higher than the second object 410 in FIG. 4. Accordingly, the first projection P1*b* corresponding to the second object considered in the third embodiment may be higher than the first projection P1*a* of the second embodiment.

In this case, if the processor 104 estimates the sound occluding factor of the third embodiment according to the teachings of the second embodiment, the sound occluding factor of the third embodiment may be estimated to be the same as the sound occluding factor of the second embodiment, even though the second object of the third embodiment is higher than the second object 410 of the second embodiment.

Therefore, in the third embodiment, after obtaining the first ratio of the first line segment L1*a* over the second line segment L2*a*, the processor 104 may correct the first ratio as the sound occluding factor based on a correcting factor. As could be observed in FIG. 5, the intersection area AR may be formed by the overlapped area OA and a non-overlapped area NOA. In one embodiment, the correcting factor may be determined based on the overlapped area OA and the non-overlapped area NOA. For example, the correcting factor may be a second ratio of the overlapped area OA over the non-overlapped area NOA, but the disclosure is not limited thereto.

After obtaining the correcting factor, the processor 104 may, for example, multiply the first ratio by the correcting factor to correct the first ratio as the sound occluding factor, but the disclosure is not limited thereto.

In FIG. 5, since the overlapped area OAa in the second embodiment is smaller than the overlapped area OAb in the third embodiment, the correcting factor in the second embodiment would be smaller than the correcting factor in the third embodiment. In this case, the sound occluding factor in the second embodiment would be smaller than the sound occluding factor in the third embodiment. Accordingly, the information loss of the height of the first projection P1*a* due to projection may be correspondingly compensated.

In summary, the embodiments of the disclosure may obtain the sound occluding factor in a way with lower computation complexity, such that the computation resource of the VR system may be utilized more efficiently. In addition, by taking the correcting factor into consideration, the accuracy of the sound occluding factor would not be overly affected by the information loss occurred in the process of projections.

It will be apparent to those skilled in the art that various modifications and variations can be made to the structure of the present invention without departing from the scope or spirit of the disclosure. In view of the foregoing, it is intended that the present disclosure cover modifications and variations of this invention provided they fall within the scope of the following claims and their equivalents.

What is claimed is:

1. A method for providing an occluded sound effect, adapted to an electronic device, comprising:

providing a virtual environment, wherein the virtual environment comprises a first object, and the first object is approximated as a second object;

defining an object detection range of a sound source based on a sound ray originated from the sound source, wherein the object detection range extends from the sound source to a sound receiver;

in response to determining that the first object enters the object detection range, defining a reference plane based on a reference point on the second object and the sound ray, wherein the reference plane has an intersection area with the object detection range;

projecting the second object onto the reference plane as a first projection;

determining a sound occluding factor based on the intersection area and the first projection; and adjusting a sound signal based on the sound occluding factor, wherein the sound signal is provided by the sound source to the sound receiver.

2. The method according to claim 1, wherein the second object is a sphere or a polyhedron.

3. The method according to claim 1, wherein the object detection range is a cone space having an apex on the sound source and centered at the sound ray.

4. The method according to claim 1, wherein the reference plane includes the reference point on the second object and is perpendicular to the sound ray.

5. The method according to claim 1, wherein the first projection has an overlapped area with the intersection area, and the step of determining the sound occluding factor based on the intersection area and the first projection comprises:

determining the sound occluding factor as a ratio of the overlapped area over the intersection area.

6. The method according to claim 1, wherein the first projection has an overlapped area with the intersection area, and the step of determining the sound occluding factor based on the intersection area and the first projection comprises:

defining a reference line based on the intersection area and the first projection, wherein the reference line passes the intersection area and the first projection;

projecting the overlapped area onto the reference line as a first line segment;

projecting the intersecting area onto the reference line as a second line segment; and determining the sound occluding factor as a first ratio of the first line segment over the second line segment.

7. The method according to claim 6, wherein the reference line intersects with the sound ray, includes the reference point on the second object, and is perpendicular with the sound ray.

8. The method according to claim 1, wherein the first projection has an overlapped area with the intersection area, and the step of determining the sound occluding factor based on the intersection area and the first projection comprises:

defining a reference line based on the intersection area and the first projection, wherein the reference line passes the intersection area and the first projection;

projecting the overlapped area onto the reference line as a first line segment;

projecting the intersecting area onto the reference line as a second line segment; and calculating a first ratio of the first line segment over the second line segment; and correcting the first ratio as the sound occluding factor based on a correcting factor.

9. The method according to claim 8, wherein the intersection area is formed by the overlapped area and a non-overlapped area, and the correcting factor is determined based on the overlapped area and the non-overlapped area.

10. The method according to claim 9, wherein the correcting factor is a second ratio of the overlapped area over the non-overlapped area.

11. An electronic device, comprising:

a non-transitory storage circuit, storing a program code; and a processor, coupled to the storage circuit and accessing the program code to perform:

providing a virtual environment, wherein the virtual environment comprises a first object, and the first object is approximated as a second object;

defining an object detection range of a sound source based on a sound ray originated from the sound source, wherein the object detection range extends from the sound source to a sound receiver;

in response to determining that the first object enters the object detection range, defining a reference plane based on a reference point on the second object and the sound ray, wherein the reference plane has an intersection area with the object detection range;

projecting the second object onto the reference plane as a first projection;

determining a sound occluding factor based on the intersection area and the first projection; and adjusting a sound signal based on the sound occluding factor, wherein the sound signal is provided by the sound source to the sound receiver.

12. The electronic device according to claim 11, wherein the second object is a sphere or a polyhedron.

13. The electronic device according to claim 11, wherein the object detection range is a cone space having an apex on the sound source and centered at the sound ray.

14. The electronic device according to claim 11, wherein the reference plane includes the reference point on the second object and is perpendicular to the sound ray.

15. The electronic device according to claim 11, wherein the first projection has an overlapped area with the intersection area, and the processor performs:

determining the sound occluding factor as a ratio of the overlapped area over the intersection area.

16. The electronic device according to claim 11, wherein the first projection has an overlapped area with the intersection area, and the processor performs:

defining a reference line based on the intersection area and the first projection, wherein the reference line passes the intersection area and the first projection;

projecting the overlapped area onto the reference line as a first line segment;

projecting the intersecting area onto the reference line as a second line segment; and determining the sound occluding factor as a first ratio of the first line segment over the second line segment.

17. The electronic device according to claim 16, wherein the reference line intersects with the sound ray, includes the reference point on the second object, and is perpendicular with the sound ray.

18. The electronic device according to claim 11, wherein the first projection has an overlapped area with the intersection area, and the processor performs:

defining a reference line based on the intersection area and the first projection, wherein the reference line passes the intersection area and the first projection;

projecting the overlapped area onto the reference line as a first line segment;

projecting the intersecting area onto the reference line as a second line segment; and calculating a first ratio of the first line segment over the second line segment; and correcting the first ratio as the sound occluding factor based on a correcting factor.

19. The electronic device according to claim 18, wherein the intersection area is formed by the overlapped area and a non-overlapped area, and the correcting factor is determined based on the overlapped area and the non-overlapped area.

20. The electronic device according to claim 19, wherein the correcting factor is a second ratio of the overlapped area over the non-overlapped area.

* * * * *